US009310113B2

(12) United States Patent
Hung et al.

(10) Patent No.: US 9,310,113 B2
(45) Date of Patent: Apr. 12, 2016

(54) THERMOELECTRIC HEAT PUMP APPARATUS

(71) Applicant: INDUSTRIAL TECHNOLOGY RESEARCH INSTITUTE, Hsin-Chu (TW)

(72) Inventors: Ming-Lang Hung, Hsin-Chu (TW); Yan-Ching Lee, Hsinchu (TW); Jyi-Ching Perng, Hsinchu County (TW); Ya-Wen Chou, Tainan (TW); Yi-Ray Chen, Hsin-Chu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 562 days.

(21) Appl. No.: 13/734,148

(22) Filed: Jan. 4, 2013

(65) Prior Publication Data

US 2013/0312426 A1 Nov. 28, 2013

(30) Foreign Application Priority Data

May 28, 2012 (TW) ..... 101118959 A

(51) Int. Cl.

| | |
|---|---|
| ***B67D 1/08*** | (2006.01) |
| ***F25B 21/04*** | (2006.01) |
| ***B67D 1/00*** | (2006.01) |
| ***B67D 1/12*** | (2006.01) |

(52) U.S. Cl.

CPC ..... *F25B 21/04* (2013.01); *B67D 1/0009* (2013.01); *B67D 1/0869* (2013.01); *B67D 1/0888* (2013.01); *B67D 1/0895* (2013.01); *B67D 1/12* (2013.01); *B67D 2210/00099* (2013.01)

(58) Field of Classification Search

CPC ..... F25B 2321/0252; F25B 21/02; F25B 2321/023; B67D 1/0869

See application file for complete search history.

(56) References Cited

U.S. PATENT DOCUMENTS

| | | | | |
|---|---|---|---|---|
| RE33,082 | E * | 10/1989 | Gerstmann | F24D 11/004 122/20 B |
| 5,590,532 | A * | 1/1997 | Bachman | B67D 1/0869 62/3.3 |
| 5,956,965 | A | 9/1999 | Watanabe et al. | |
| 8,001,794 | B2 | 8/2011 | Windisch | |
| 2005/0257532 | A1 * | 11/2005 | Ikeda | F25B 21/02 62/3.7 |
| 2007/0034356 | A1 * | 2/2007 | Kenny | F04B 17/00 165/80.4 |

FOREIGN PATENT DOCUMENTS

| | | |
|---|---|---|
| CN | 2361199 Y | 2/2000 |
| CN | 2368420 Y | 3/2000 |
| CN | 2422595 Y | 3/2001 |

(Continued)

OTHER PUBLICATIONS

Japaness Office Action issued on Sep. 30, 2014.

(Continued)

*Primary Examiner* — Cassey D Bauer
(74) *Attorney, Agent, or Firm* — Rabin & Berdo, P.C.

(57) ABSTRACT

A drinking dispenser has a warm water container; a hot water container coupled to the warm water container; a water supplying apparatus separately coupled to the warm water container and the hot water container; and a thermoelectric heat pump apparatus, configured with a pump that is arranged coupling to the water container and a thermoelectric module in respective coupled to the water container and the pump.

10 Claims, 8 Drawing Sheets

(56) References Cited

FOREIGN PATENT DOCUMENTS

| | | | |
|---|---|---|---|
| CN | 1408308 | A | 4/2003 |
| CN | 2657542 | Y | 11/2004 |
| CN | 101569504 | A | 11/2009 |
| CN | 102283575 | A | 12/2011 |
| FR | 2726453 | A1 | 5/1996 |
| JP | H0673679 | U | 10/1994 |
| JP | H11201614 | A | 7/1999 |
| JP | 2000193390 | A | 7/2000 |
| JP | 2001255037 | A | 9/2001 |
| JP | 2002147889 | A | 5/2002 |
| JP | 2004084982 | A | 3/2004 |
| JP | 2007087774 | A | 4/2007 |
| JP | 2007240117 | A | 9/2007 |
| JP | 2008-232502 | A | 10/2008 |
| JP | 2011106759 | A | 6/2011 |
| JP | 2011153776 | A | 8/2011 |
| KR | 10-2008-0085622 | A | 3/2009 |
| TW | 168296 | | 9/1991 |
| TW | 552390 | B | 9/2003 |
| TW | I296473 | | 12/2004 |
| TW | M272959 | | 8/2005 |
| TW | M285680 | U | 1/2006 |
| TW | M287420 | U | 2/2006 |
| TW | M287424 | U | 2/2006 |
| TW | I294510 | | 4/2006 |
| TW | M378363 | | 4/2010 |
| TW | M403633 | | 5/2011 |
| WO | WO-2011030339 | A2 | 3/2011 |

OTHER PUBLICATIONS

Qinghai Luo et al., "A novel water heater integrating thermoelectric heat pump with separating thermosiphon", Applied Thermal Engineering, vol. 25, Apr. 28, 2005, pp. 2193-2203.

Howard Chen et al., "A Novel VLSI Technology to Manufacture High-Density Thermoelectric Cooling Devices", 13th International Workshop on Thermal Investigations of ICs and Systems—Therminic 2007, Budapest, Hungary, Sep. 17-19, 2007, pp. 1-6.

Jin Xie et al., "Design, Fabrication, and Characterization of CMOS MEMS-Based Thermoelectric Power Generators", Journal of Microelectromechanical Systems, Vol. 19, No. 2, Apr. 2010, pp. 317-324.

Di Liu et al., "Modeling and Performance Investigation of a Closed-Type Thermoelectric Clothes Dryer", Drying Technology, vol. 26, No. 10, pp. 1208-1216, Oct. 2008.

Terry Hendricks, "Thermal System Interactions in Optimizing Advanced Thermoelectric Energy Recovery Systems", Journal of Energy Resources Technology, Sep. 2007, vol. 129, No. 3, pp. 223-231.

Gao Min et al., "Thermoelectric figure-of-merit under large temperature differences", Journal of Physics D: Applied Physics, vol. 37, Mar. 31, 2004, pp. 1301-1304.

Taiwan Patent Office, Office Action, Patent Application Serial No. TW101118959, Feb. 10, 2015, Taiwan.

China Patent Office, Office Action issued on Jan. 27, 2015.

Japanese Office Action issued on Jan. 28, 2014.

* cited by examiner

THERMOELECTRIC HEAT PUMP APPARATUS

CROSS REFERENCE TO RELATED APPLICATION

The present application is based on, and claims priority from, Taiwan (International) Application Serial Number 101118959, filed on May 28, 2012, the disclosure of which is hereby incorporated by reference herein in its entirety.

TECHNICAL FIELD

The present disclosure relates to a drinking dispenser and a thermoelectric heat pump apparatus thereof

BACKGROUND

Thermoelectric chip is a device designed and used to transfer heat from one side of a device to the other, with consumption of electrical energy, depending on the direction of the current. Operationally, when direct current runs through a thermoelectric chip, heat is moved from one side to the other. Therefore it can be used either for heating or for cooling. It can be applied as a cooler in electronic devices, refrigerator, drinking dispensers or air conditioners.

U.S. Pat. No. 8,001,794, issued to Robert Windisch, discloses a thermoelectric heat exchange system for fluids, in which a thermoelectric cooling module is used for cooling a fluid.

Regarding a conventional household drinking dispenser, a thermoelectric chip is generally functioning as a cooler or heater received therein. Here, when the thermoelectric chip is used for cooling, a heat sink attached on the hot side of the thermoelectric chip for dissipating heat; on the other hand, when the thermoelectric chip is used for heating, the thermal module including thermoelectric chip and heat exchanger should be adapted to function as a heat source for water heating. The temperature of water which contains in the drinking dispenser is only driven by the natural convection. Therefore, there is a significantly temperature gradient along the water container.

Beside the limitation of thermoelectric material, the thermal energy leakage from water container to the ambient environment, through thermoelectric module, further lower the efficiency of conventional thermoelectric cooler or heater. In most conventional water heaters, the thermoelectric module shuts down as the temperature is achieved to the setting point. Basically, thermoelectric module is a very good thermal conductor for thermal energy transportation. After shutting down the thermoelectric module, the thermal energy including heating energy or cooling energy in the water will be easily dissipated to the ambient environment through thermoelectric module. Thus, the thermal energy preservation effect of the container is very poor.

Conventionally, for improving the efficiency of thermoelectric module for drinking dispensers, the drinking dispensers are generally made of materials with high thermal conductivity. However, by doing so, water temperature is changing even faster. Consequently, for some commercial products, it is common to apply a small voltage on the thermoelectric chip to work as a thermal resistance when the designed water temperature is achieved in the drinking dispenser. The water temperature can be kept for a longer time. However, the additional applying voltage caused more power consumption and is not good for energy conservation.

SUMMARY

The present disclosure relates to a thermoelectric heat pump apparatus that is adapted for a water container, and the thermoelectric heat pump apparatus comprises: a thermoelectric module, separately coupled to the water container; and a pump, coupled to the thermoelectric module.

In an embodiment, the present disclosure provides a drinking dispenser, comprising: a warm water container; a hot water container, coupled to the warm water container; a water supplying apparatus, separately and respectively coupled to the warm water container and the hot water container; and a thermoelectric heat pump apparatus, having a pump coupled to the water container and a thermoelectric module coupled to the water container and the pump in respective.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

Figure 1:
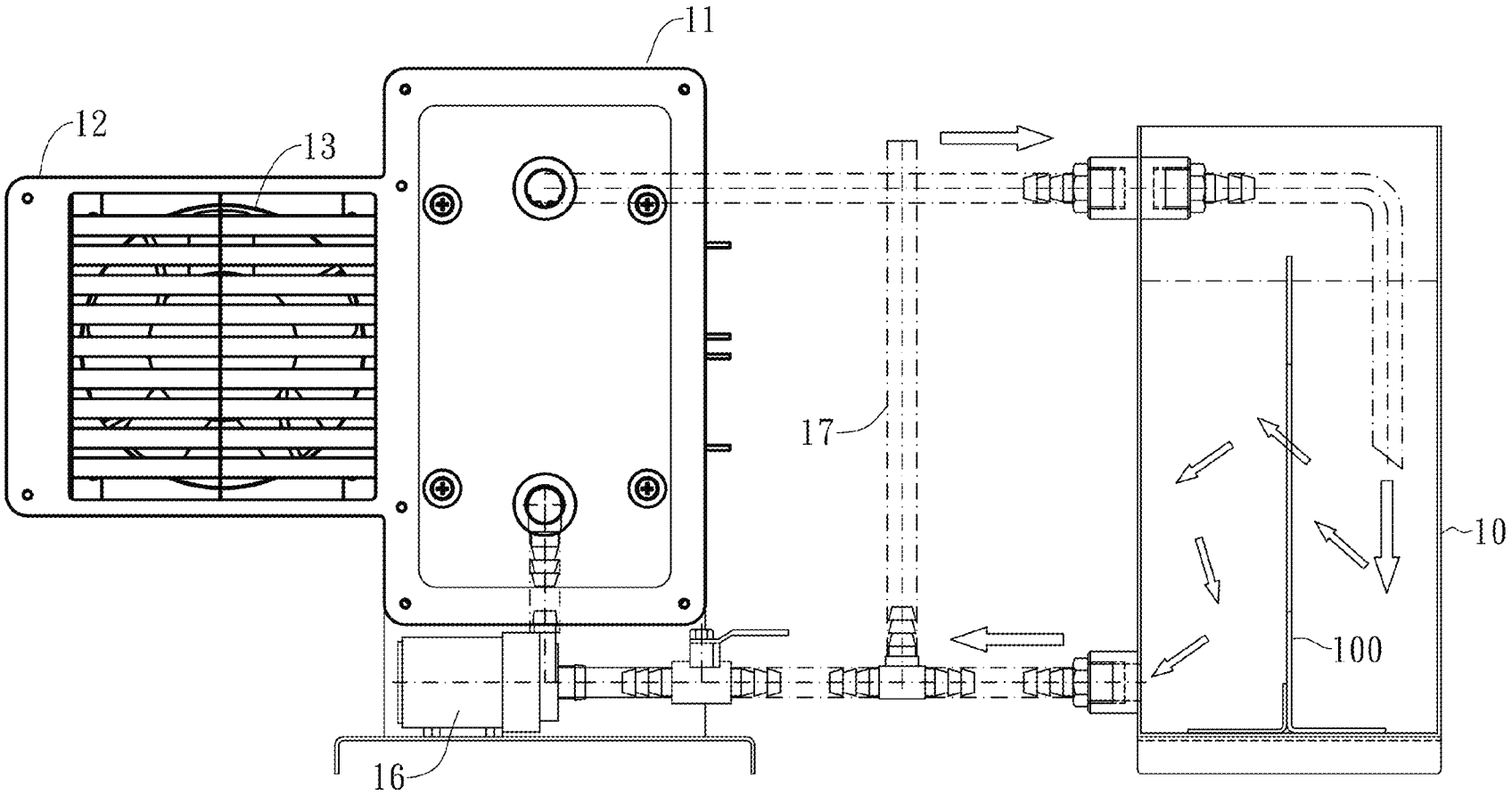
FIG. 1 is a schematic diagram showing a thermoelectric heat pump apparatus according to an exemplary embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Please refer to FIG. 1, which is a sectional diagram shown a thermoelectric heat pump apparatus according to an exemplary embodiment of the present disclosure. As shown in FIG.

1, the thermoelectric heat pump apparatus that is adapted for a container 10, comprised a thermoelectric module 11 and a pump 16.

Figure 2:
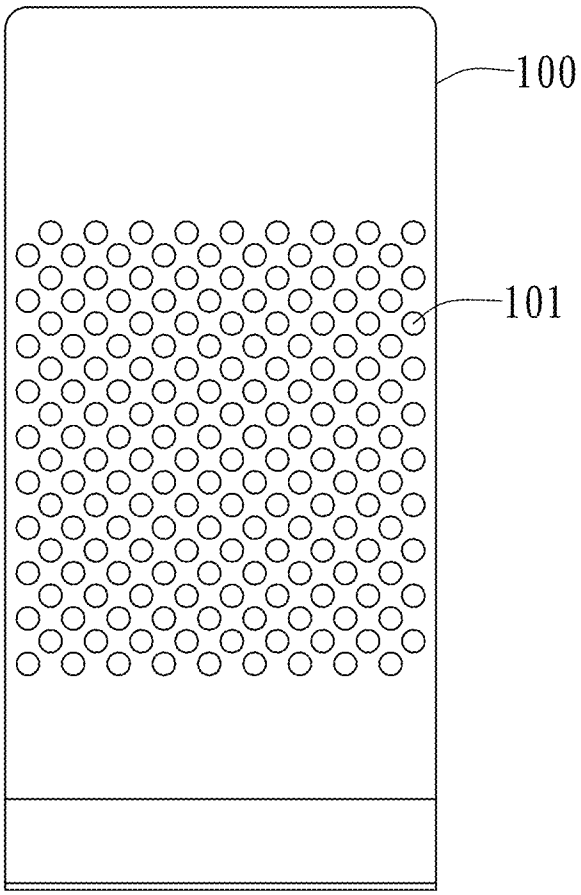
FIG. 2 is a schematic view of a flow-disturbing baffle.

In a container 10 shown in FIG. 1, a flow-disturbing baffle 100 is received therein; and as shown in FIG. 2, the flow-disturbing baffle 100 is formed with a plurality of interrupting holes 101. The flow-disturbing baffle 100 is used for a flow resistance to prevent a short circulation path between the entrance of water container 10 and a water circulation inlet of the container 10. Therefore, the flow-disturbing baffle 100 enhanced the forced convection effect in the container 10.

Figure 3:
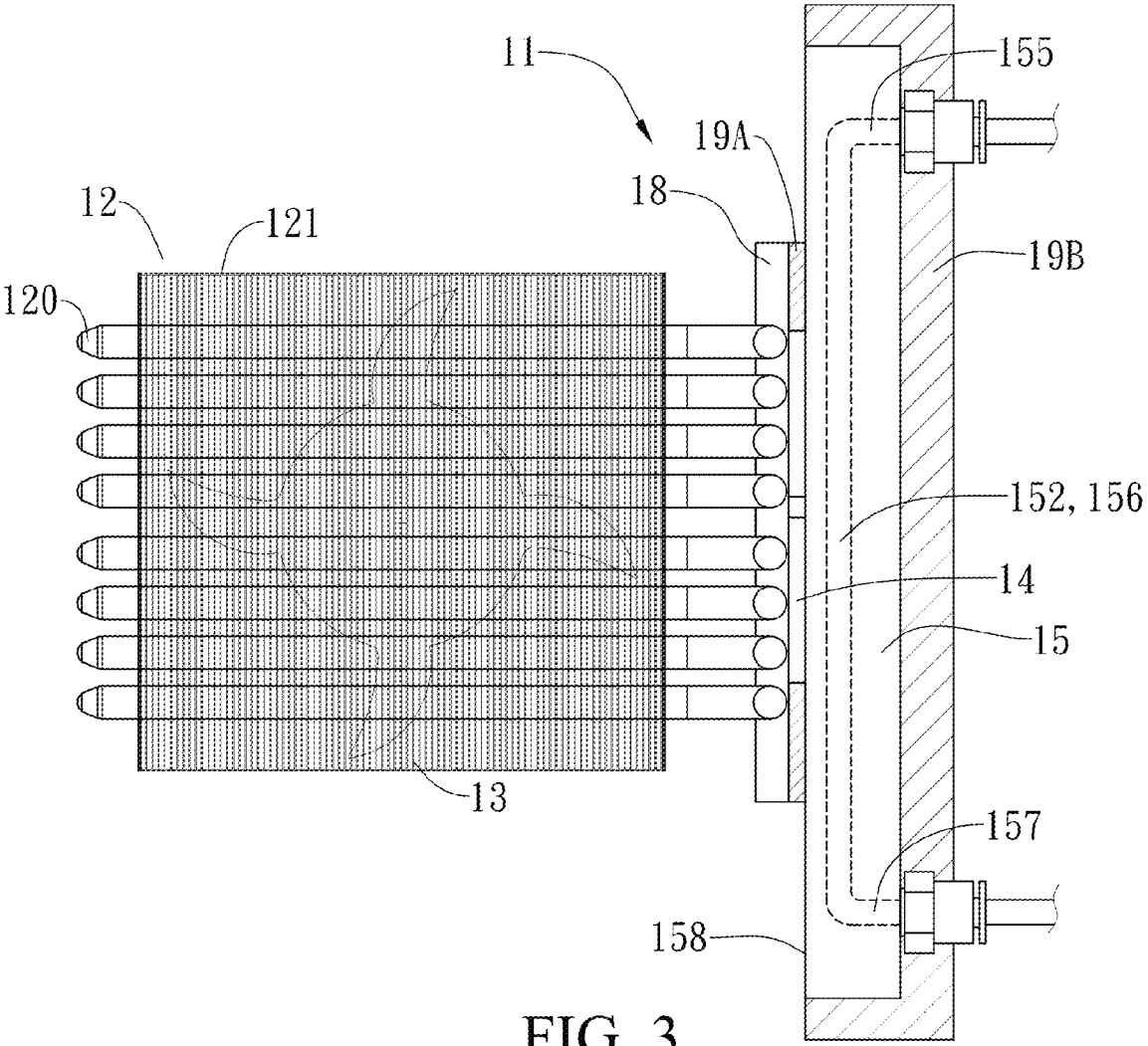
FIG. 3 is a schematic diagram showing a portion of a thermoelectric heat pump apparatus according to an embodiment of the present disclosure.

Please refer to FIG. 3, which is a schematic diagram showing a portion of a thermoelectric heat pump apparatus according to an embodiment of the present disclosure. As shown in FIG. 1 and FIG. 3, the thermoelectric module 11 is further configured with a first heat exchanger 12, a fan 13, at least one thermoelectric chip 14, a second heat exchanger 15, an exhaust pipe 17, a contact plate 18, a first insulator 19A and a second insulator 19B. Wherein, the first heat exchanger 12 is configured with a plurality of heat pipes 120 and a plurality of heat-exchanging fins 121 in a manner that the plural heat pipes 120 are embedded in the plural heat-exchanging fins 121; the fan 13 installed on one side of the heat exchanger 12; and the thermoelectric chip 14 is coupled to the heat exchanger 12 by a surface thereof. In an embodiment, thermoelectric chip 14 closely contacted with the contact plate 18 by a surface thereof while being coupled to the heat pipes 120. It is noted that there can be only one thermoelectric chip 14 or a plurality of thermoelectric chip 14 being included in the thermoelectric module 11.

Figure 4:
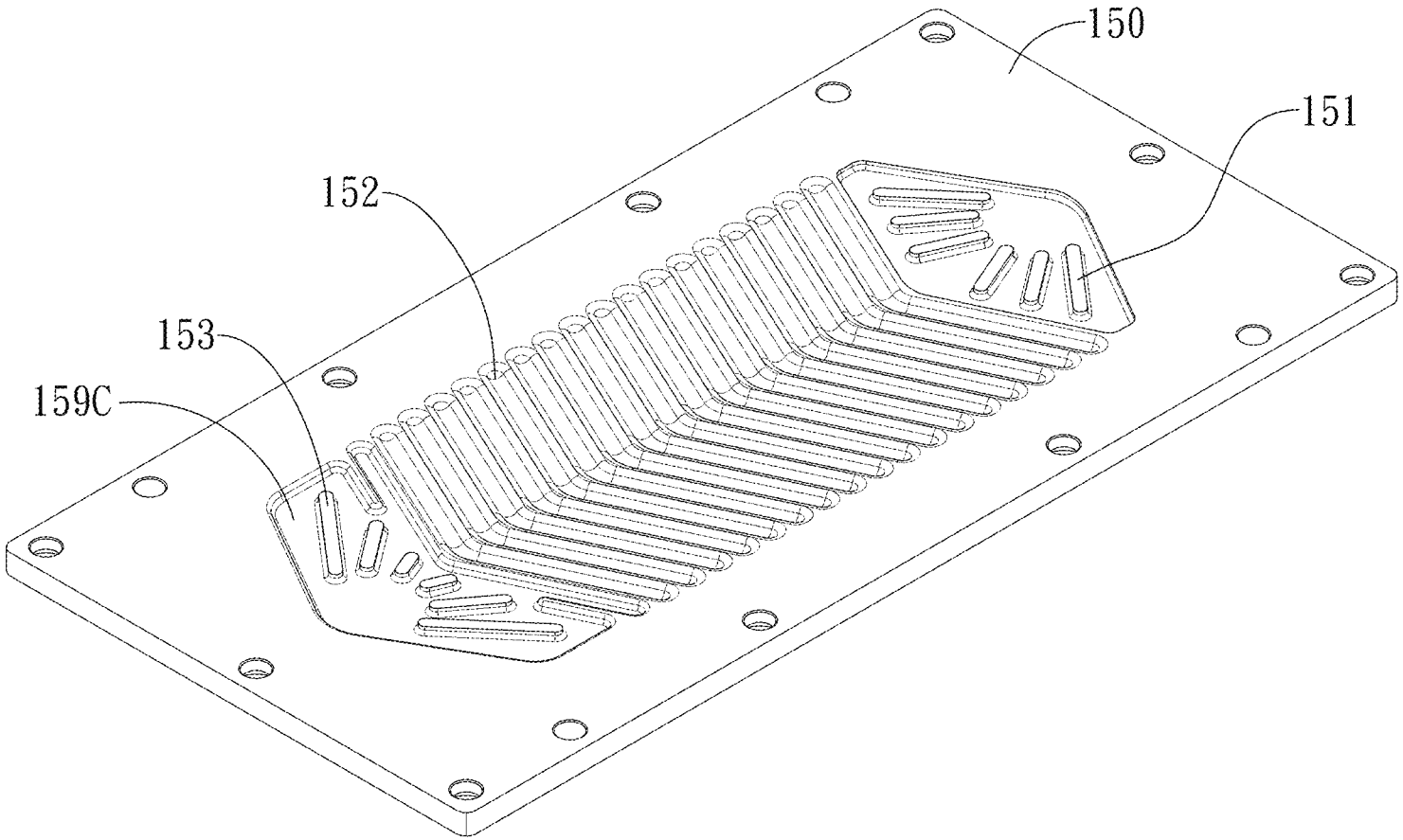
FIG. 4 is a schematic view of a first panel.
Figure 5:
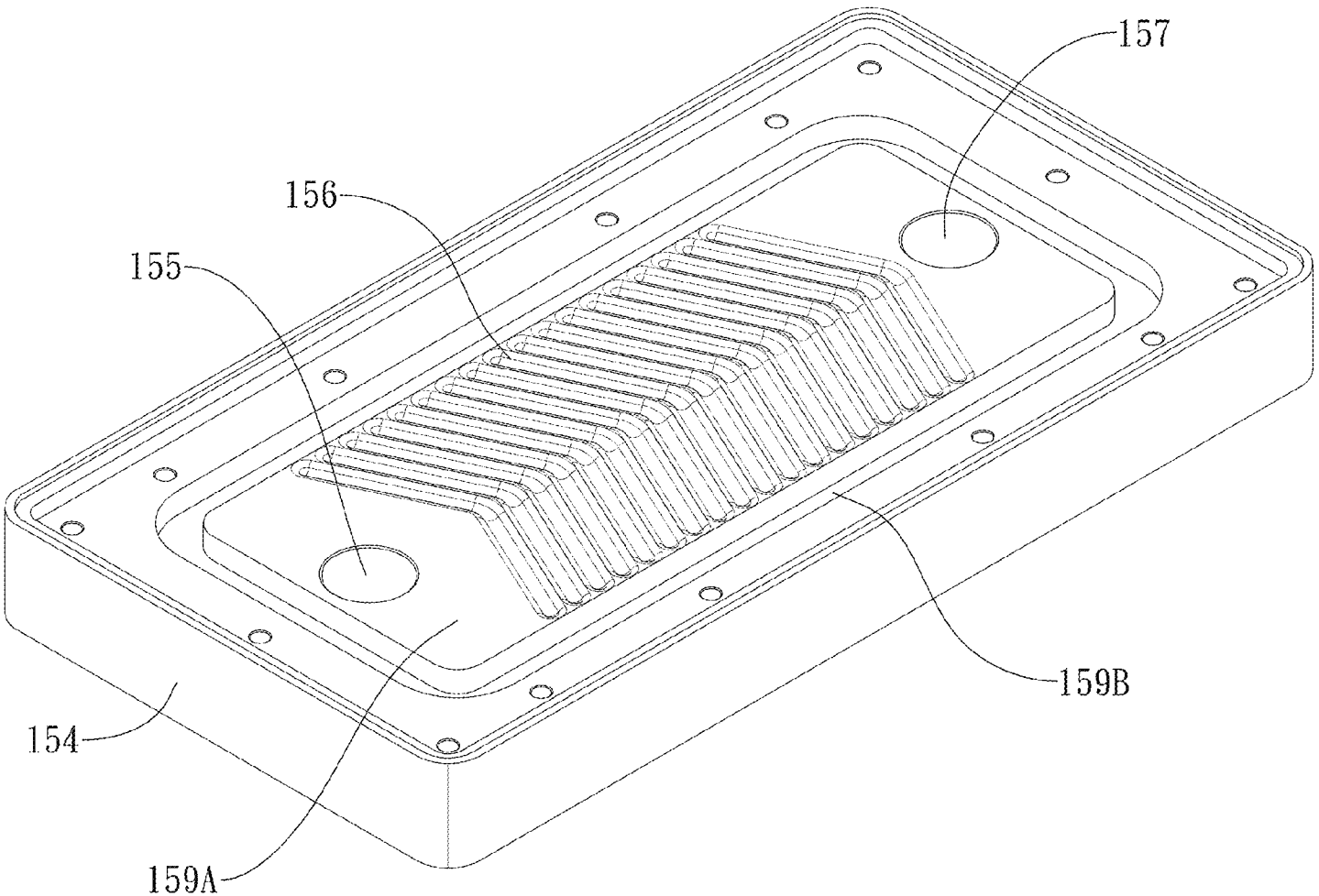
FIG. 5 is a schematic view of a second panel.

As shown in FIG. 4 and FIG. 5, the second heat exchanger 15 is configured with a panel 150 and a second panel 154, and the first panel 150 is further formed with a flow distributor 151, a flow channel 152 and a flow collector 153 on a surface thereof, while enabling the flow channel 152 to be disposed between the flow distributor 151 and the flow collector 153. Another surface of the first panel 150, that is not provided for the flow distributor 151, the flow channel 152 and the flow collector 153, is a smooth surface 158 for allowing the thermoelectric chip 14 to mount thereat. In an embodiment, the surface of the first panel 150, that is provided for the flow distributor 151, the flow channel 152 and the flow collector 153, is formed along a concave plate 159C, by that the flow distributor 151 and the flow collector 153 are protrudent on the bottom surface of concave plate 159C and radially distributed toward the flow channel 152 in respective, as the flow channel 152 is also arranged on the bottom surface of the concave plate 159C. In this embodiment, the flow channel 152 is a collection of a plurality of V-shaped flow channels.

Moreover, the second panel 154, being coupled to the first panel 150, is formed with an inlet hole 155, a flow channel 156 and an outlet hole 157, while enabling the flow channel 156 to be disposed between the inlet hole 155 and the outlet hole 157. In this embodiment, the inlet hole 155 is further connected to the container 10 by a pipe, while being positioned near to the flow distributor 151. In addition, the flow channel 156 of the second panel 154 is arranged at a position corresponding to the flow channel 152 of the first panel 150, and the outlet hole 157 is positioned neighboring to the flow collector 153 for allowing the same to be connected to the container 10 by the use of a pipe. Operationally, the flow distributor 151 is used for guiding drinking water from the intake hole 155 to flow into the flow channels 152, 156, and the flow collector 153 is used for guiding the drinking water from the flow channels 152, 156 to flow into the outlet hole 157. In an embodiment, the second panel 154 is configured on the surface of convex plate 159A thereof in a manner that the convex plate 159A is surrounded by a circular groove 159B having a leakage-proof seal disposed therein, while allowing the inlet hole 155 and the outlet hole 157 to be disposed respectively at the two ends of the convex plate 159A, and the flow channel 156 to be formed on the second panel 154 with the convex plate 159A. Moreover, the size of convex plate 159A should be larger than or equal to the concave plate 159C of the first panel 150, and similarly, the flow channel 156 of the second panel 154 is a collection of a plurality of V-shaped flow channels.

The water flow paths 152 and 156 are channeled on the first panel 150 and the second panel 154. The radially flow distributor 151 is provided for guiding a fluid, such as a clean water, a drinking water, a cold water or a hot water, whichever is fed into the second heat exchanger 15 through the inlet hole 155 to uniformly flow into the flow channels 152, 156, where increase the fluid turbulence and enhanced the heat exchange rate of the second heat exchanger 15, and thereby, the temperature of the fluid can be raised or lowered accordingly. Moreover, the leakage-proof seal is provided for preventing the leakage of fluid while flowing inside the second heat exchanger 15. In addition, the radially distributed flow collector 153 is provided for collecting all the fluid from the flow channels 152, 156 and guiding them to the outlet hole 157 to be discharged outside the second heat exchanger 15.

In addition to the making of the flow channels 152, 156 into collections of a plurality of V-shaped flow channels, the heat transfer unit 150 is made of a material with high thermal conductivity, such as an aluminum alloy or copper. If it is made of an aluminum alloy, the aluminum alloy must be processed by an anode treatment; and if it is made of copper, the copper should be coated with a layer of stainless steel in a thickness ranged between 0.002 mm and 0.006 mm. For instance, the thickness of the stainless steel layer can be 0.002 mm, 0.0025 mm, 0.003 mm, 0.0035 mm, 0.004 mm, 0.0045 mm, 0.005 mm, 0.0055 mm, or 0.006 mm.

In this embodiment, the pump 16 is connected respectively to the container 10 and the inlet hole 155 through different pipelines, while allowing an exhaust pipe 17 to be arranged at a position between the pump and the container; and the container 10 is disposed separating from the thermoelectric module 11. Moreover, the contact plate 18 is attached to the thermoelectric chip 14 on a surface where is provided to coupled with the heat pipes 120, by that the thermal energy produced from the thermoelectric chip 14 can be transmitted to the first heat exchanger 12. In the embodiment shown in FIG. 3A, the first insulator 19A is arranged sandwiched between the contact plate 18 and the second heat exchanger 15 and is substantially a hollow component made of insulation foam. The first insulator 19A prevents the thermal energy produced by thermoelectric chip 14 dissipate into ambient environment. In a way that the thermal energy generated by the operation of the thermoelectric chip 14 is conserved. In addition, the second insulator that is also made of insulation foam, is arranged wrapping around the second heat exchanger 15 for preventing the energy dissipation through the second heat exchanger 15.

As shown in FIG. 1 and FIG. 3, in a condition when the thermoelectric chip 14 is enabled to provide heat energy to the second heat exchanger 15, the drinking water running through the second heat exchanger 15 will be heated thereby effectively. The heat exchange rate between the drinking water and the second heat exchanger 15 is enhanced by the flow channels 152, 156. Thereafter, the heated water is fed into the container 10 where it is being drawn by the pump 16 to flow back into the second heat exchanger 15 so as to be heating again. Simultaneously, at the other side of the thermoelectric chip 14, the cold energy is transmitted through the contact plate 18 to the heat pipes 120 where it is further transmitted to the heat exchange fins 121 so as to be dissipated into ambient environment by the help of the fan 13.

On the other hand, in a condition when the thermoelectric chip 14 is provided cold energy to the second heat exchanger 15, the drinking water running through the second heat exchanger 15 will be cooled down thereby, while the heat generated by the thermoelectric chip will be transmitted through the contact plate 18 to the heat pipes 120 where it is further transmitted to the heat exchange fins 121 so as to be dissipated into ambient environment by the help of the fan 13.

Figure 8:
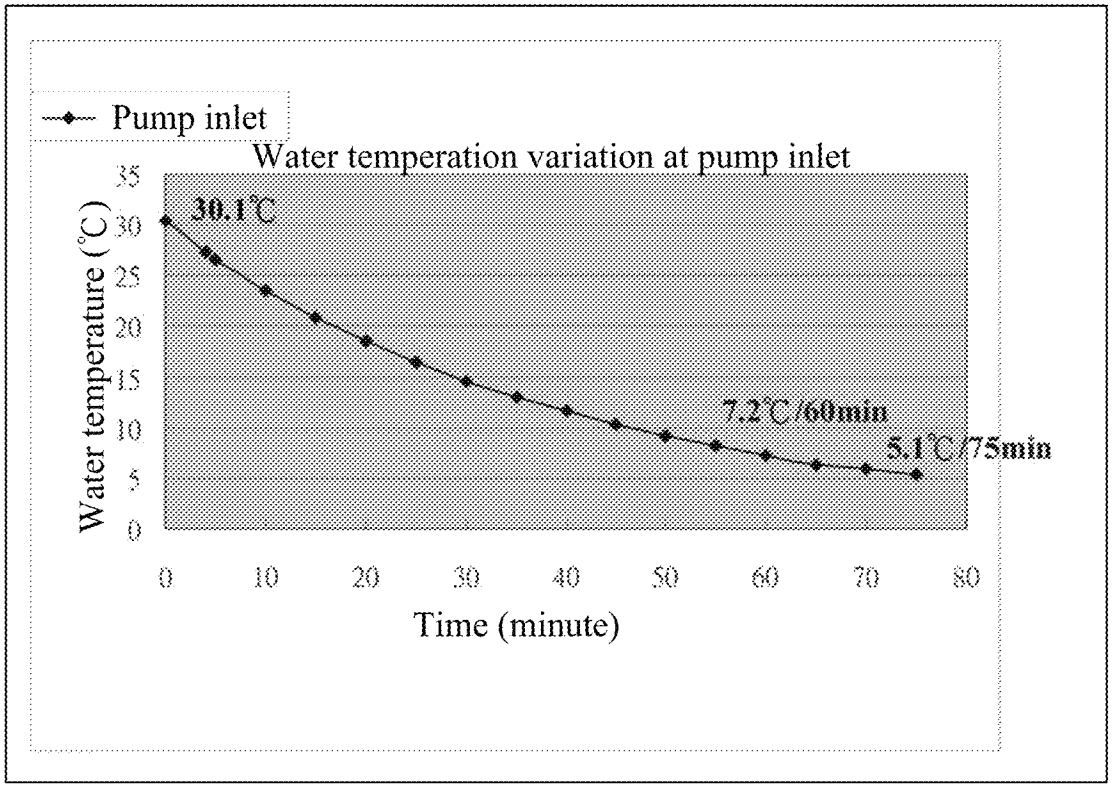
FIG. 8 is a diagram showing the variation of water temperature inside a container through time according to a test result of a thermoelectric heat pump apparatus of the present disclosure.

The effectiveness of the thermoelectric heat pump apparatus of the present disclosure can be shown in the test result of FIG. 8 with reference to FIG. 3, whereas the test is performed using a same amount of water at a specific temperature upon a thermoelectric heat pump apparatus of the present disclosure. In this test, water of 2300 cc and 30.1° C. feed into the second heat exchanger 15 while the thermoelectric chip 14 is enabled to cool the second heat exchanger 15, by that the water is cooled down for enabling the its temperature to drop from 30.1° C. to 7.2° C. within only 60 min and take about 75 min for lower the temperature from 30.1° C. to 5.1° C. Comparing with other cooling devices currently available, it will take about 110 min to cool the same amount of water from 26.3° C. to 7.4° C. Thus, the performance efficiency of the present disclosure is enhanced by 55.

Figure 6:
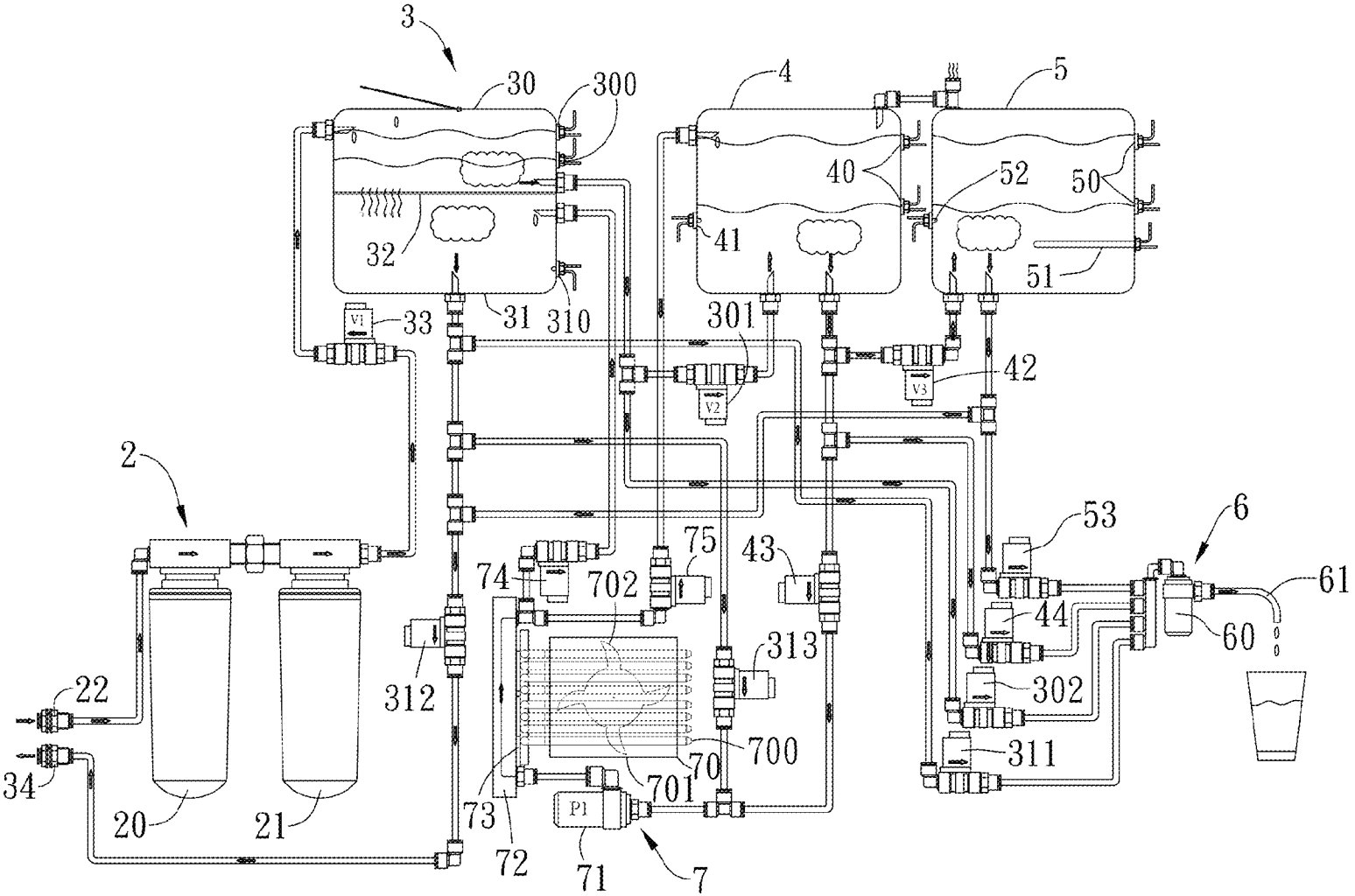
FIG. 6 is a schematic diagram showing a drink dispenser according to an exemplary embodiment of the present disclosure.

Please refer to FIG. 6, which is a sectional diagram shown a drink dispenser according to an exemplary embodiment of the present disclosure. In this embodiment, the drinking dispenser comprises: a water purification unit 2, a reservoir 3, a warm water container 4, a hot water container 5, a water supplying apparatus 6 and a thermoelectric heat pump apparatus. Moreover, the water purification unit 2 is configured with a first water purifier 20, a second water purifier 21 and a water supply connector 22. In an embodiment, the first water purifier 20 is substantially an active carbon column that is connected in fluid communication with the water supply connector 22 through a pipe, while the second water purifier 21 is substantially an ultraviolet germicidal lamp that is connected in fluid communication with the first water purifier 20 through a pipe.

In addition, the reservoir 3 is configured with a clean water container 30, at least one clean water level sensor 300, a first clean flow outlet control valve 301, a second clean flow outlet control valve 302, a cold water container 31, a cold water temperature sensor 310, a first cold flow outlet control valve 311, a drainage control valve 312, a second cold flow outlet control valve 313, a partition plate 32, a clean flow intake control valve and a drain connector 34.

In this embodiment, the clean water container 30 is connected in fluid communication with the second purifier 31 through a pipe; the clean water level sensor 300 is disposed inside the clean water container 30; the first clean water outlet control valve 301 and the second clean water outlet control valve 302 are connected respectively in fluid communication with the clean water container 30 through a pipe.

Moreover, the cold water container is connected in fluid communication with the clean water container 30, and is used for containing water at temperature between 4° C. to 8° C. The cold water temperature sensor 310 is disposed inside the cold water container 31; the first cold flow outlet control valve 311, the drainage control valve 312 and the second cold flow outlet control valve 313 are connected respectively in fluid communication with the cold water container 31 through a pipe.

In addition, the partition plate 32 is disposed at a position between the clean water container 30 and the cold water container 31, and is formed with a plurality of via holes for allowing the clean water in the clean water container 30 to flow into the cold water container 31. There is a clean flow intake control valve 33 arranged on the pipeline at a position between the clean water container 30 and the second water purifier 21; the drain connector 34 is connected in fluid communication with the first clean flow outlet control valve 312 through a pipe.

In this embodiment, the warm water container 4, being connected in fluid communication with the first clean flow outlet control valve 301 through a pipe, is configured with at least one warm water level sensor 40, a warm water temperature sensor 41, a first warm flow outlet control valve 42, a second warm flow outlet control valve 43, a third warm flow outlet control valve 44. It is noted that the warm water container 4 is designed for containing water at temperature ranged between 50° C. to 70° C.

Moreover, the at least one warm water level sensor 40 and the warm water temperature sensor 41 are disposed inside the warm water container 4; the first warm flow outlet control valve 42, the second warm flow outlet control valve 43 and the third warm flow outlet control valve 44 are connected respectively in fluid communication with the warm water container 4 through a pipe.

The hot water container 5, being connected in fluid communication with the first warm flow outlet control valve 42 and the drainage control valve 312 through a pipe, is configured with at least one hot water level sensor 50, a heater 51, a hot water temperature sensor 52, a hot flow outlet control valve 53. It is noted that the hot water container 5 is designed for containing water at a temperature higher than 90° C. Moreover, the at least one hot water level sensor 50, the heater 51 and the hot water temperature sensor 52 are all disposed inside the hot water container 5; and the hot flow outlet control valve 53 is connected in fluid communication with hot water container 5 through a pipe. It is noted that the heater 51 can be an immersion heater.

As disclosed in the above description, the reservoir 3, along with the warm water container 4 and the hot water container 5 that are shown in FIG. 6 are used and function in a way similar to the container 10 shown in FIG. 1, so that each of the reservoir 3, the warm water container 4 and the hot water container 5 can have a flow-disturbing baffle arranged therein, and the reservoir 3 and the warm water container 4 are arranged separating from the thermoelectric heat pump apparatus 7.

The water supplying apparatus 6 is configured with a water drawing pump 60 and a feeding tube 61, in which the water drawing pump 60 is connected respectively in fluid communication with the cold flow outlet control valve 311, the second clean flow outlet control valve 302, the third warm flow outlet control valve 44 and the hot flow outlet control valve 53 through different pipes; and the feeding tube is connected in fluid communication with the water drawing pump 53.

As disclosed in the embodiment shown in FIG. 1, the thermoelectric heat pump apparatus 1 further comprises: a cold flow intake control valve 74 and a warm flow intake control valve 75, whereas the cold flow intake control valve 74, the warm flow intake control valve 75 and the pump 71 are connected in fluid communication with the heat transfer unit 72 of the thermoelectric module 70 through different pipes, while allowing the pump 71 to further connected respectively to the second warm flow outlet control valve 43 and the second clod flow outlet control valve 313 through different pipes.

Similar to the exhaust pipe 17 shown in FIG. 1, there are exhaust pipes that are arranged respectively at positions between the cold water container 31 and the pump 71, and between warm water container 4 and the pump 71.

Figure 7:
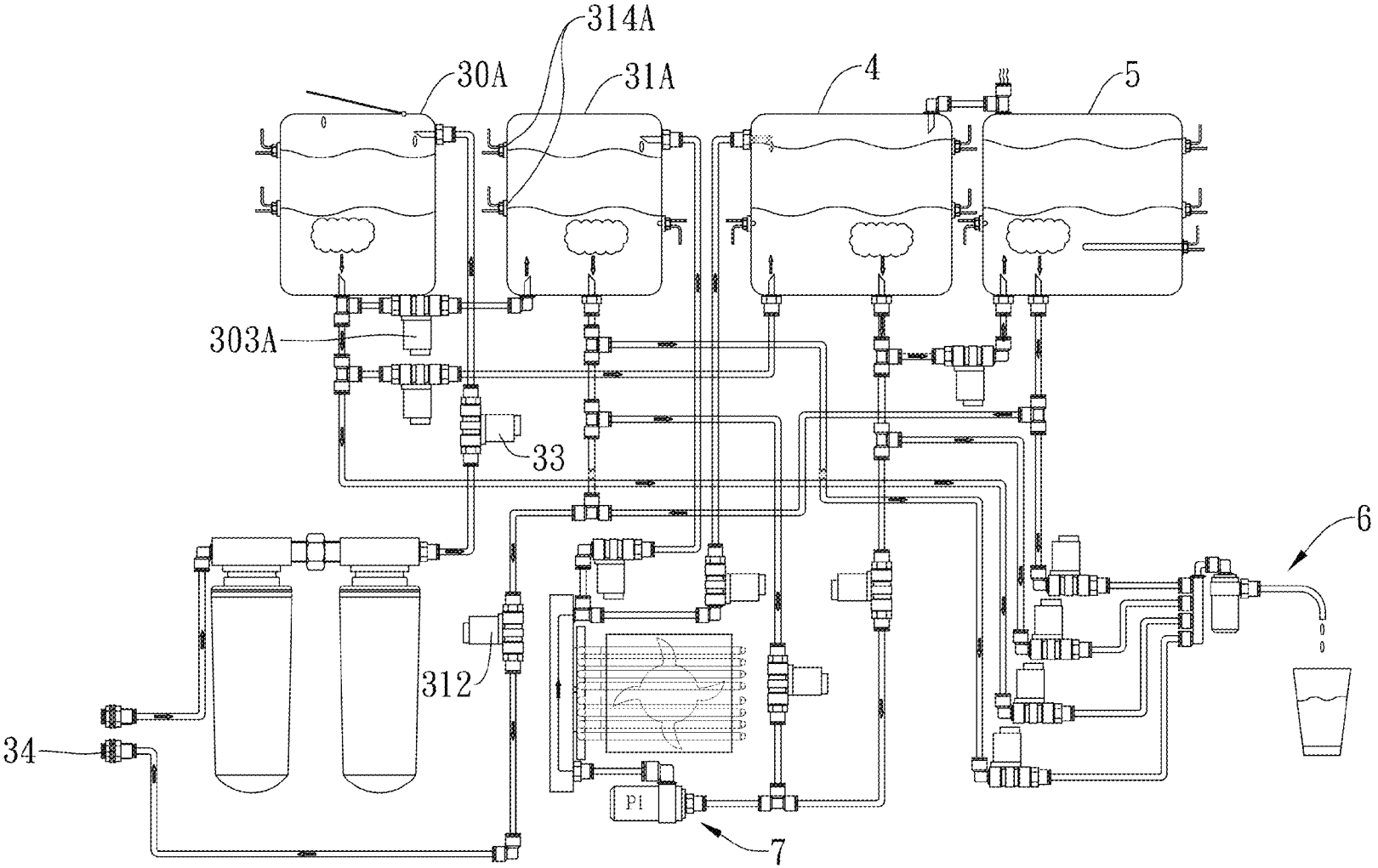
FIG. 7 is a schematic diagram showing a drink dispenser according to another exemplary embodiment of the present disclosure.

Please refer to FIG. 7, which is a schematic diagram showing a drink dispenser according to another exemplary embodiment of the present disclosure. Since this embodiment is only a derivative of the one shown in FIG. 6, there are some components being numbered the same as those used in FIG. 6.

In the embodiment shown in FIG. 7, there are two individual containers, i.e. a clean water container 30A and a cold water container 31A, used instead of the container 3 of FIG. 6 which is a single container with partition plate 32. Moreover, the clean water container 30A is connected in fluid communication with a third clean flow outlet control valve 303A through a pipe, and is also simultaneously connected to a second water purifier 21, a water supplying apparatus 6, and a warm water container 4 in a way the same as those shown in the embodiment of FIG. 6. In addition, the cold water container 31A further has at least one cold water level sensor 314A to be arranged therein, and is connected in fluid communication with a drain connector 34, the water supplying apparatus 6, a thermoelectric heat pump apparatus 7 in a way the same as those shown in the embodiment of FIG. 6.

Accordingly, one single container as the one container 10 shown in FIG. 1 can be provided to function in the same way as the clean water container 30A and the cold water container 31A, whereas the flow-disturbing baffle is arranged inside the cold water container 31A. Thereby, similar to the embodiment shown in FIG. 6, a fluid can be fed to a first purifier 20 and a second purifier 21 through a water supply connector 22 so as to be purified. Thereafter, as the water level in the clean water container 30 is detected and measured by a clean water level sensor and if the water level in the clean water container 30 is lower than a threshold value, the clean flow intake control valve 33 will be enabled to open wider for allowing more purified water to flow into the clean water container 30. On the other hand, if the water level in the clean water container 30 is higher than a threshold value, the clean flow intake control valve 33 will either be closed for shutting down purified water from flowing into the clean water container 30, or be enabled to narrow its opening for reducing the mount of water flowing into the clean water container 30. Consequently, the purified water at a room temperature inside the clean water container 30 is separated from mixing with the cold water in the cold water container 31 by the partition plate 32, while only allowing the purified water to flow into the cold water container 31 in time through the via holes formed on the partition plate 32 when the water amount in the cold water container 31 is lower than a threshold value.

On the other hand, in the embodiment shown in FIG. 7, the flow of water into the clean water container 30A is controlled by the clean flow intake control valve 33, while the flow of purified water into the cold water container 31A is controlled by the third clean water outlet control valve 303A, and the third clean water outlet control valve 303A is opened for allowing the purified water to flow into the cold water container 31A when water amount in the cold water container 31 is lower than a threshold value.

In the following description, the activation and operation in the two embodiments of FIG. 6 and FIG. 7 that are performed in the same way will be illustrated using the embodiment of FIG. 7, but the difference will be illustrated using the embodiment of FIG. 7.

As shown in FIG. 6, the flow of water into the warm water container 4 from the clean water container 30 is controlled by the first clean flow outlet control valve 301, and the first clean flow outlet control valve 301 is opened for allowing the purified water to flow into the warm water container 4 when water amount in the warm water container 4 is lower than a threshold value.

The flow of water into the water supplying apparatus 6 from the clean water container 30 is controlled by the second clean flow outlet control valve 302, and water reaching the water supplying apparatus 6 can be drawn and pumped by the water drawing pump 60 to flow out of the water supplying apparatus 6 through the feeding tube 61 so as to be received by a user. Thus, if the second clean flow outlet control valve 302 is closed, there will be no clean water from the water supply apparatus 6.

The flow of cold water into the thermoelectric heat pump apparatus 7 from the cold water container 31 is controlled by the second cold flow outlet control valve 313, whereas the flow of cold water reaching the thermoelectric heat pump apparatus 7 that is drawn by the pump 71 can be heated or cooling down even more.

For cooling down the water flowing into the thermoelectric heat pump apparatus 7 from the cold water container 31, the thermoelectric chip 73 is enabled to work at a higher power for enabling the temperature of water reaching the thermoelectric chip 73 to drop further when the cold water temperature sensor inside the cold water container 31 detects that the temperature of the water inside the cold water container 31 is higher than a specific temperature. However, if the temperature of the water inside the cold water container 31 is not higher than the specific temperature, the cold flow intake control valve will be closed and the thermoelectric heat pump apparatus 7 is disabled, whereas the flow of cold water into the cold water container 31 from the second heat exchanger 72 is controlled by the cold flow intake control valve 74.

When the thermoelectric chip 73 is used for cooling water, the heat generated from the thermoelectric chip 73 will be transmitted to the heat exchanging fins 701 through the heat pipes 700 so as to be dissipated into ambient environment by the fan 702.

As described in the above description, the cold water container 31 can be replenished by the purified water in the clean water container 30, while the replenished water in the cold water container 31 can be cooled down by the thermoelectric heat pump apparatus 7 to a desired low temperature. On the other hand, in FIG. 7, the replenishing of the cold water container 31A is controlled by the opening and closing of the third clean flow outlet controlled valve 303A, while the replenished water in the cold water container 31A can be cooled down by the thermoelectric heat pump apparatus 7 to a desired low temperature.

As shown in FIG. 6, when the first cold water outlet control valve 311 is opened, the cold water inside the cold water container 31 can be provided to the water supply apparatus 6, but when it is closed, the cold water inside the cold water container 31 can not be provided to the water supply apparatus 6.

Moreover, the flow of water into the warm water container 4 from the clean water container 30 is controlled by the first clean flow outlet control valve 301, and the first clean flow outlet control valve 301 is opened wider for allowing more purified water to flow into the warm water container 4 when the warm water level sensor 40 detected that the water level in the warm water container 4 is lower than a threshold value. On the other hand, if the water level in the warm water container 4 is higher than or equal to the threshold value, the first clean flow outlet control valve 301 will be closed for shutting down the flow of purified water form entering into the warm water container 4.

The warm water inside the warm water container 4 is allowed to flow into the thermoelectric heat pump apparatus 7 when the second warm water outlet control valve 43 is opened, and thus the warm water reaching the second heat exchanger 72 in the thermoelectric heat pump apparatus 7 will be heated even more by the thermoelectric chip 73.

When the thermoelectric chip 73 is used for heating water, the thermal energy from the cold side of thermoelectric chip 73 will be transmitted to the second heat exchanging fins 701 through the heat pipes 700 so as to be dissipated into ambient environment by the fan 702.

The warm water temperature sensor 41 is used for detecting the water temperature of the warm water container 4, and if the detected water temperature is lower than a threshold value, the thermoelectric chip 73 is enabled to work at a higher power for enabling the temperature of water reaching the thermoelectric chip 73 to be raised while enabling the warm water intake control valve 75 to open for allowing water in the heat transfer unit 72 to flow into the warm water container 4.

On the other hand, if the water temperature of the warm water container 4 is equal to or higher than the threshold value, the thermoelectric heat pump apparatus 7 is disabled and both the second warm water outlet control valve 43 and the warm water intake control valve 75 will be closed.

In addition, when the third warm water outlet control valve 42 is opened, the warm water inside the warm water container 4 can be provided to the water supply apparatus 6, but when it is closed, the warm water inside the warm water container 4 can not be provided to the water supply apparatus 6. Similarly, when the first warm water outlet control valve 42 is opened, the warm water inside the warm water container 4 can be provided to the hot water container 5, and when the hot water level sensor inside the hot water container 5 detects that the water level of the hot water container 5 is higher than or equal to a threshold value, the first warm water outlet control valve 42 will be closed for shutting down the flow of warm water of the warm water container 4 from entering into the hot water container 5.

When the hot water outlet control valve 53 is opened, the hot water inside the hot water container 5 can be provided to the water supply apparatus 6, but when it is closed, the hot water inside the hot water container 5 can not be provided to the water supply apparatus 6. Operationally, the heater 51 will be enabled for heating the water inside the hot water container 5 when the hot water temperature sensor 52 inside the hot water container 5 detects that the water temperature of the hot water container 5 is lower than a threshold value, and the heater 51 will be disabled when the water temperature of the hot water container 5 is equal to or higher than the threshold value.

In a condition when it is required to drain all the water containing in the reservoir 3, the warm water container 4, and the hot water container 5 for cleaning, or even for transporting, or fixing the whole drinking dispenser of the present disclosure, the drainage control valve 312 will be opened for allowing water in the reservoir 3, the warm water container 4, and the hot water container 5 to be discharged through the drain connector 34.

According to the above description, the operation efficiency of the thermoelectric heat pump apparatus of the present disclosure is improved comparing to prior art either for cooling or for heating that it can be adapted for a drinking dispenser. Moreover, the thermal energy loss is minimized to almost zero after the thermoelectric chip is disabled.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A thermoelectric heat pump apparatus, adapted for a container, comprising:

a thermoelectric module, separately coupled to the water container; and a pump, coupled to the thermoelectric module;

wherein the thermoelectric module further comprises: a first heat exchanger, a fan, at least one thermoelectric chip, and a second heat exchanger; and the first heat exchanger is connected respectively to the fan and the at least one thermoelectric chip, while the second heat exchanger is connected respectively to the thermoelectric chip and the container;

wherein the first heat exchanger is further configured with a contact plate, a first insulator and a second insulator in a manner that the contact plate is arranged at a position between the heat exchanger and the thermoelectric chip, the first insulator is arranged at a position between the thermoelectric chip and the contact plate, while the second insulator is arranged wrapping around the heat transfer unit;

wherein the second heat exchanger is configured with a first panel and a second panel, and the first panel is further formed with a flow distributor, a flow channel and a flow collector on a surface thereof, while enabling the flow channel to be disposed between the flow distributor and the flow collector; and the second panel, being coupled to the first panel, is formed with an inlet hole, a flow channel and an outlet hole, while enabling the flow channel of the second panel to be disposed between the inlet hole and the outlet hole at a position corresponding to the flow channel of the first panel in a condition that the outlet hole is positioned near to the flow collector; and wherein each of the two flow channels is a collection of a plurality of V-shaped flow channels.

2. The thermoelectric heat pump apparatus of claim 1, wherein the container is configured with a flow-disturbing baffle formed with a plurality of interrupting holes; and wherein the flow-disturbing baffle separates the cold water and warm water in said container.

3. The thermoelectric heat pump apparatus of claim 1, wherein the first heat exchanger is configured with a plurality of heat pipes and a plurality of heat-exchanging fins in a manner that the plural heat pipes are embedded in the plural heat-exchanging fins.

4. The thermoelectric heat pump apparatus of claim 1, wherein the first insulator is substantially a hollow component made of insulation foam, and the second insulator is substantially a component made of insulation form.

5. The thermoelectric heat pump apparatus of claim 1, wherein the second heat exchanger is made of a material with high thermal conductivity.

6. The thermoelectric heat pump apparatus of claim 5, wherein the material with high thermal conductivity is a material selected from the group consisting of: an aluminum alloy and copper.

7. The thermoelectric heat pump apparatus of claim 5, wherein the material with high thermal conductivity is a material selected from the group consisting of: an aluminum alloy and copper; and each of the two flow channels is coated with a layer of stainless steel.

8. The thermoelectric heat pump apparatus of claim 7, wherein the layer of stainless steel is formed in a thickness ranged between 0.002 mm and 0.006 mm.

9. The thermoelectric heat pump apparatus of claim 1 wherein the first panel has a concave surface thereof, while allowing the flow distributor, and the flow collector to be arranged protruding out from the concave surface and radially distributed toward the flow channel in respective, as the flow channel is also arranged on the concave surface; the second panel is configured with a convex surface thereof in a manner that the convex surface is surrounded by a circular groove having a leakage-proof seal disposed therein, while allowing the inlet hole and the outlet hole to be disposed respectively at the two ends of the convex surface, and the flow channel of the second panel to be formed on the convex surface.

10. The thermoelectric heat pump apparatus of claim 1, further comprising:

an exhaust pipe, disposed at a position between the pump and the container.

* * * * *